US006424307B1

(12) United States Patent
Nutt

(10) Patent No.: US 6,424,307 B1
(45) Date of Patent: Jul. 23, 2002

(54) ANTENNA MOUNTING ASSEMBLY FOR A GUIDED-MICROWAVE SPECTROMETER

(75) Inventor: Sherel F. Nutt, Oregon, WI (US)

(73) Assignee: Weiler and Company, Inc., Whitewater, WI (US)

( * ) Notice: Subject to any disclaimer, the term of this patent is extended or adjusted under 35 U.S.C. 154(b) by 0 days.

(21) Appl. No.: 09/954,798

(22) Filed: Sep. 18, 2001

(51) Int. Cl.[7] ..... H01Q 11/12

(52) U.S. Cl. ..... 343/741; 343/872; 324/640; 34/259

(58) Field of Search ..... 343/741, 742, 343/866, 867, 872; 324/639, 640, 636; 34/259, 265, 549; 374/14; H01Q 11/12, 13/00, 1/42

(56) References Cited

U.S. PATENT DOCUMENTS 5,455,516 A * 10/1995 Jean et al. ..... 324/639
6,092,924 A * 7/2000 Scalese et al. ..... 374/14
6,247,246 B1 * 6/2001 Scalese et al. ..... 34/259

* cited by examiner

*Primary Examiner*—Hoanganh Le
(74) *Attorney, Agent, or Firm*—Boyle, Fredrickson, Newholm, Stein & Gratz, S.C.

(57) ABSTRACT

An in-line, guided-microwave spectrometer has an antenna mounting assembly that is particularly useful in sanitary applications, such as food processing systems. The antenna mounting assembly reduces the likelihood of leakage that can corrupt the electrical operation of the system. The mounting assembly includes antenna cover plate which has a recess, and a dielectric antenna window body which has a flange which fits into the recess. The seam between the dielectric window body flange and the recess in the cover plate where adhesive is applied is isolated from an area of high pressure due to this configuration. Also, a back cover is preferably mounted over the back side of the antenna cover plate to protect electrical components on the back side of the cover plate during high pressure wash downs.

22 Claims, 3 Drawing Sheets

FIG. 1
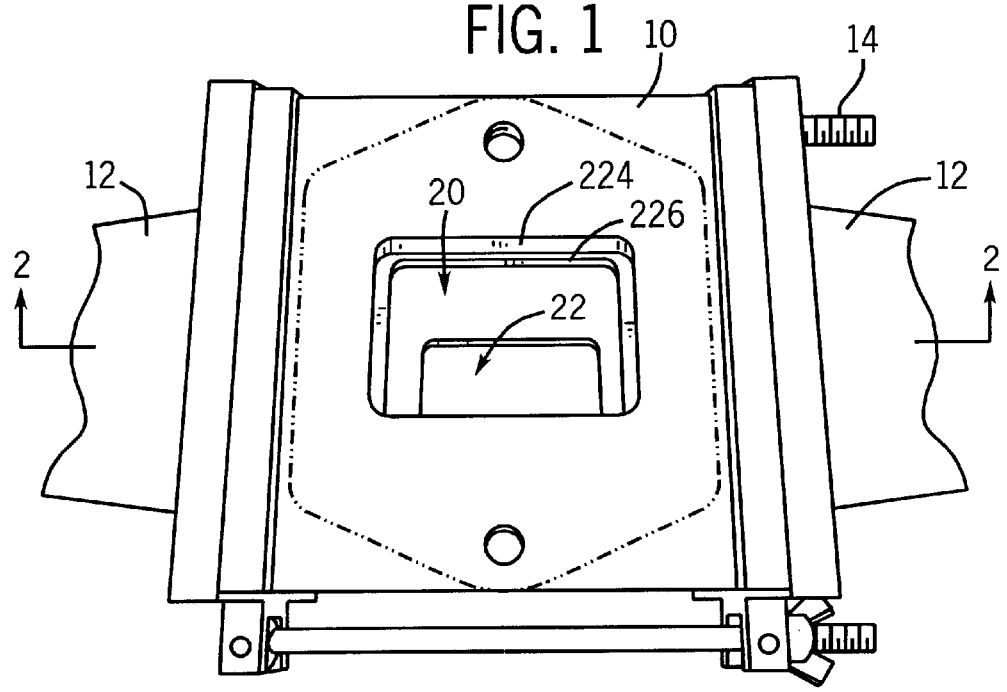
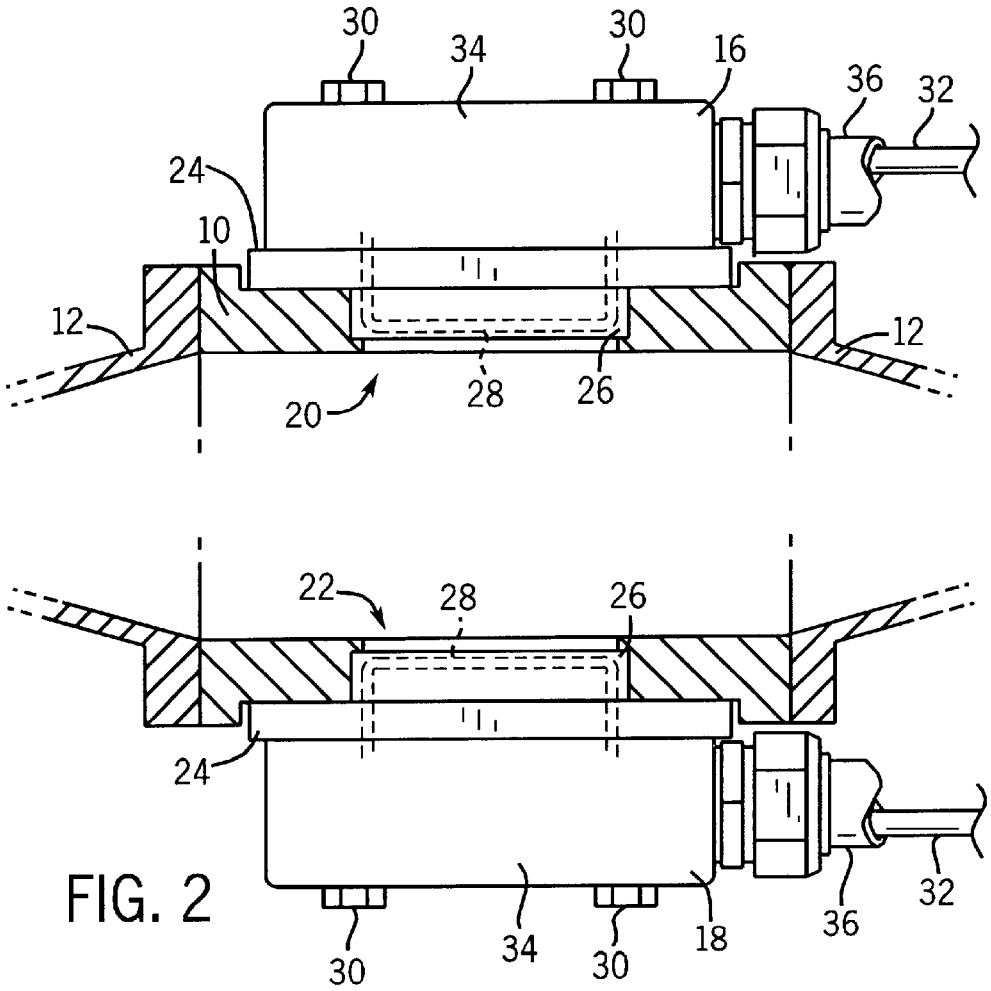
FIG. 2

ANTENNA MOUNTING ASSEMBLY FOR A GUIDED-MICROWAVE SPECTROMETER

FIELD OF THE INVENTION

The invention relates generally to in-line, guided-microwave spectrometers and in particular to a mounting assembly for in-line, guided-microwave spectrometers used in food processing systems.

BACKGROUND OF THE INVENTION

In-line analysis of food product in food processing systems can be accomplished accurately using guided-microwave spectrometers. For instance, in meat processing systems, fat, protein, moisture and salinity can be accurately measured in-line with this technology. In-line analysis is desirable because it substantially reduces, or can even eliminate, process downtime.

In an in-line, guided-microwave spectrometer processed food flows through a wave guide measurement chamber. A transmitting antenna contained within a dielectric window body is mounted within an antenna window in a sidewall of the measurement chamber. The transmitting antenna is typically copper. The dielectric window-body is typically a molded polymer, such as polytetrafluoroethylene (PTFE), polypropylene, or other suitable polymers. A receiving antenna, also typically copper, is contained within another dielectric window body that is mounted within a window through an opposite side of the measurement chamber. The antenna and the dielectric window bodies are mounted to stainless steel cover plates that are attached to the walls of the measurement chamber in order to mount the antenna through the windows in the measurement chamber. The backside of the cover plate includes microwave coaxial cable connectors. Coaxial cable is fed from the connectors to an electronic processor. In general, the guided-microwave spectrometer is able to determine various properties of the food product flowing through the measurement chamber in real-time based on detecting electromagnetic properties of the flowing food product.

In order for accurate, reliable operation, it is important that the electromagnetic antenna be protected from contamination. In food processing applications, pipe pressure can be as high as 500 to 1000 psi. Due to the high pressure within the measurement chamber, juices sometimes migrate along the seam between the dielectric window bodies and the wall of the measurement chamber. This negation along the seam can contaminate the region of the copper antenna which can lead to a degradation in measurement capability.

Another potential problem with in-line guided-microwave spectrometers in food processing applications relates to the need for high-pressure washdowns of the equipment in order to meet sanitary requirements. It is not uncommon during a high-pressure washdown for water supplied from a 1000–1500 psi hose to directly hit various components of the equipment, including the backside electronics of the wave guide antenna. Under such conditions, the electronics are susceptible to both mechanical damage and water damage.

SUMMARY OF THE INVENTION

The invention is a mounting assembly for the antennas of a guided-microwave spectrometer that renders the antennas more robust in sanitary or other washdown-type applications, such as food processing. More specifically, the geometry of the antenna cover plate and the geometry of the dielectric antenna window body are designed to better isolate the antenna region from leakage. This is accomplished by a configuration in which the joint between the dielectric window body and the cover plate, where adhesive is applied, is removed from an area of high pressure. In addition, a mounting assembly in accordance with the invention also preferably includes a back cover that is designed to protect the electrical components on the backside of the cover plate during high pressure washdown.

More specifically, the mounting assembly for the antennas includes an antenna cover plate that mounts to the measurement chamber over an antenna window in the wall of the chamber. The antenna cover plate has an antenna side (front side) and a connector side (back side). The antenna is mounted to the antenna cover plate such that the antenna loop extends away from the antenna side (front side) and the pair of microwave connectors are located on the connector side (back side). In accordance with the invention, the antenna cover plate includes a recess on the antenna side that surrounds the antenna loop. The dielectric window body covers the antenna loop and fits within the recess in the antenna side of the antenna cover plate. The antenna preferably resides within a longitudinal groove in a backside of the dielectric window body. The dielectric window body has a main body portion that extends away from the antenna cover plate and fits closely with in the antenna window on the wall of the measurement chamber. Thus, a side surface of the main body portion abuts the surface surrounding the window on the window opening side walls along a first seam. The dielectric window body also include an integral flange that extends peripherally outward from the main portion. The flange fits closely within the recess in the antenna side of the antenna cover plate. A peripheral edge of the flange abuts a wall in the antenna cover plate defining the perimeter of the recess in the antenna cover plate along a second seam. Adhesive is applied between the flange and the cover plate, preferably along and near the second seam. The adhesive is isolated from the food product and from high pressure leakage because the second seam is offset from the first seam between the sidewall of the main portion of the window body and the window opening sidewall. In addition, the second seam is located such that it interfaces entirely against an outer surface of the wall of the measurement chamber.

In another aspect, the backside of the antenna cover plate preferably includes a groove that entirely surrounds the pair of microwave connectors as well as holes in the cover plate for fasteners to mount the dielectric antenna window body to the cover plate. As mentioned, a back cover, preferably made of a material resistant to food process cleaning agents, covers the connector side of the cover plate. The back cover has a projecting rim from its lower circumferential edge that fits in the groove on the connector side of the plate. Preferably, an O-ring is located within the groove between the antenna cover plate and the edge of the projecting rim on the back cover. There is also preferably an opening in the back cover for the microwave cable. Conduit covers the microwave cable as it approaches the back cover and is preferably connected to the back cover using a threaded conduit connector in order to render the entire backside of the assembly water-tight even under high pressure washdown conditions.

Other features of the invention may be apparent to those skilled in the art upon reviewing the drawings and the following description thereof.

BRIEF DESCRIPTION OF THE DRAWINGS

FIG. 1 is a perspective view showing a measurement chamber for an in-line, guided-microwave spectrometer of the type used in food processing systems.

FIG. 2 is a view taken along lines 2—2 in FIG. 1 showing the measurement chamber, and also including an illustration of a transmitting antenna and a receiving antenna mounted to the measurement chamber in accordance with the invention.

DETAILED DESCRIPTION OF THE DRAWINGS

Figure 3:
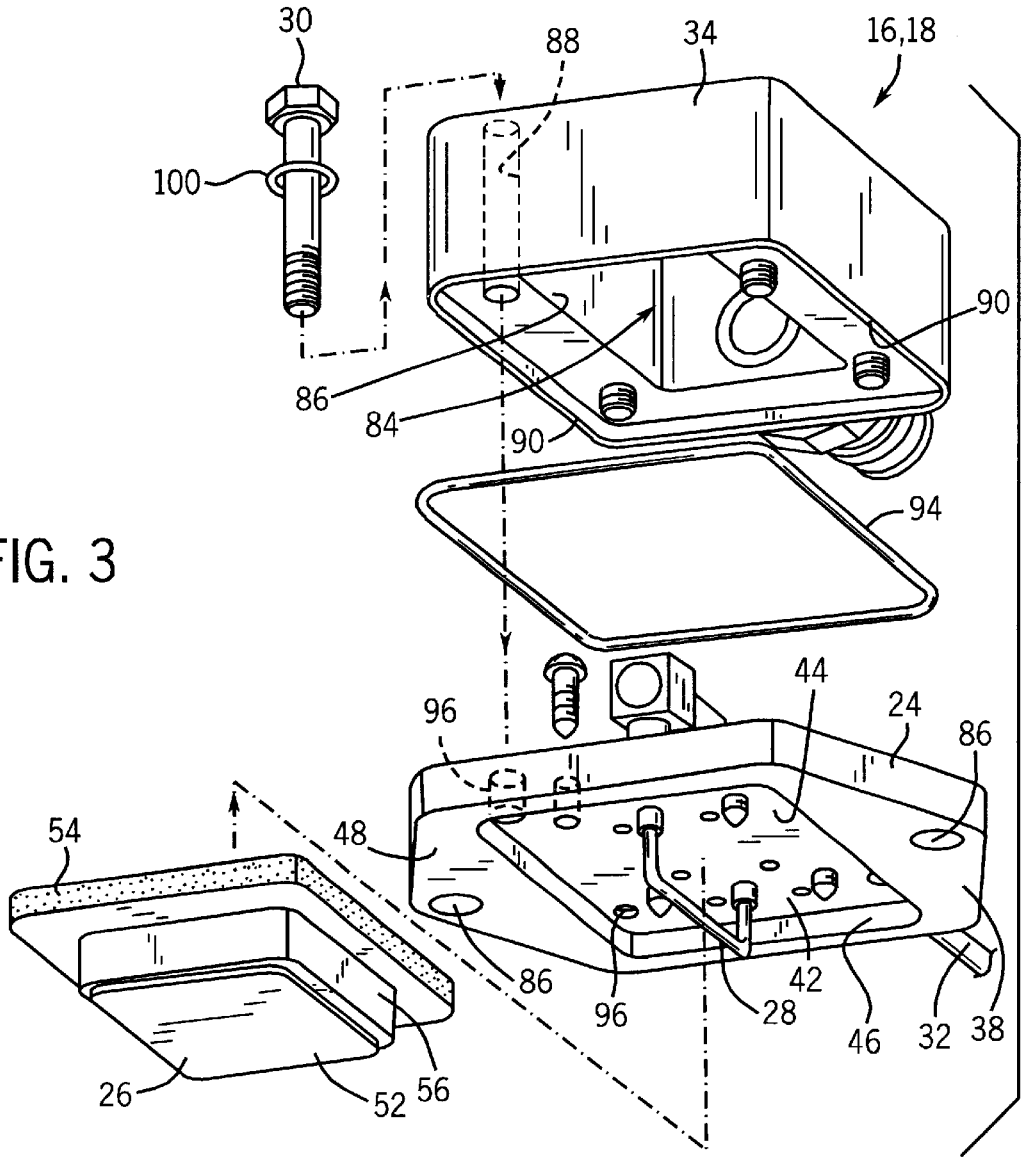
FIG. 3 is an exploded view of a mounting assembly for an antenna in a guided-microwave spectrometer which is in accordance with a preferred embodiment of the invention.

FIG. 1 illustrates a measurement chamber 10 for an in-line guided-microwave spectrometer. The measurement chamber 10 is mounted between transition members 12 in any satisfactory manner, as known in the art. The measurement chamber 10 as well as the transition members 12 are preferably made of stainless steel.

In FIG. 1, the transmitting antenna assembly 16 and the receiving antenna assembly 18 are not shown mounted to the measurement chamber 10 in order to illustrate antenna windows 20 and 22 through opposing side walls of the measurement chamber 10. The antenna windows 20, 22 are generally rectangular, and are designed to hold a dielectric window body when the antenna assemblies 16, 18 are mounted to the measurement chamber 10 generally in accordance with the prior art.

Figure 6:
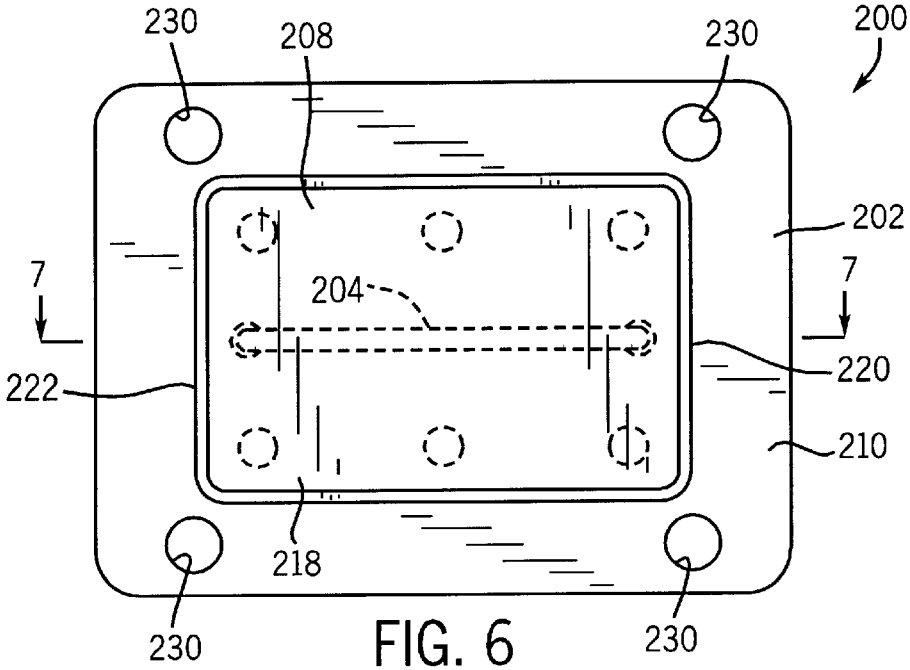
FIG. 6 PRIOR ART
FIG. 6 is a plan view of an antenna side of a mounting assembly in accordance with the prior art.
Figure 7:
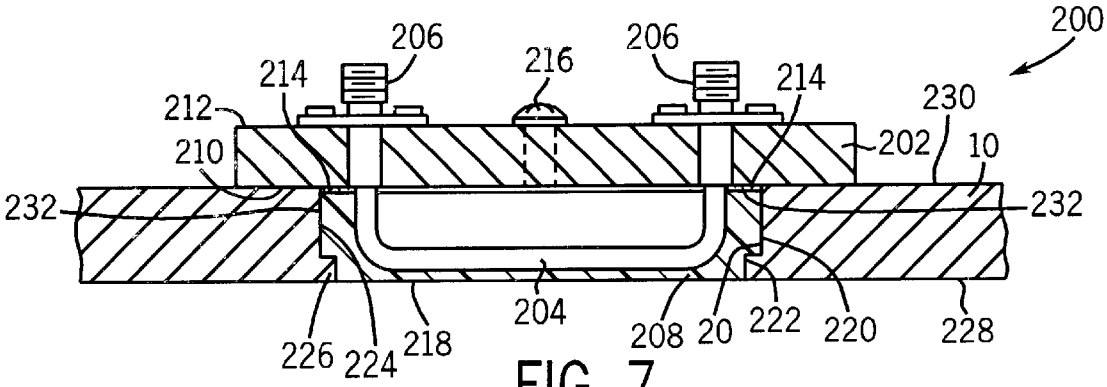
FIG. 7 PRIOR ART
FIG. 7 is a view of the prior art mounting assembly as taken along line 7—7 in FIG. 6.

FIGS. 6 and 7 show a prior art antenna mounting assembly 200 that fits in the windows 20, 22 through the walls of the measurement chamber 10. The prior art antenna assembly 200 includes antenna cover plate 202 (typically made of stainless steel), a copper antenna 204, microwave connectors 206 and a dielectric window body 208. The antenna 204 and the microwave connectors 206 are mounted to the antenna cover plate 202 such that the antenna loop extends from a front side 210 of the antenna cover plate, and the microwave connectors 206 extend from a backside 212 of the antenna cover plate 202. The dielectric window body 208 is secured to the front side 210 of the antenna cover plate 202 by adhesive 214, as well as one or more fasteners through the cover plate 202 such as fastener 216. A longitudinal groove is provided in the dielectric window body 208 in order to allow the dielectric window body 208 to fit over the antenna loop 204 during assembly.

The dielectric body 208 has a front face surface 218 that is in intimate contact with food product flowing through the measurement chamber 10. The front face surface 218 of the dielectric window body 208 is preferably planar and preferably flush with the inside surface of the side wall of the measurement chamber 10. The dielectric body 208 has sidewalls 220 that are generally perpendicular to the front face surface 218. The sidewalls 220 include a notch 222 along the outer surface at the location where the wall 220 meets the front face surface 218. The notch 222 extends completely around the periphery of the rectangular front face surface 218 (see FIG. 6), and is important for proper mounting of the assembly 200 through the window 20, 22 in the side wall of the measurement chamber. The window opening side wall surface 224 include ledge 226 that extends entirely around the window 20, 22 adjacent the inside surface 228 of the measurement chamber wall 10. The notch 222 on the dielectric body 208 nests against the support ledge 226.

The antenna cover body 202 includes fastener openings 230 (FIG. 6). Fasteners, such as bolts, pass through openings 230 in the antenna cover plate 202 and into the wall 10 of the measurement chamber in order to secure the cover plate 202, the antenna 204, the dielectric body 208 and the remaining components of the antenna assembly to the measurement chamber 10. When mounted, the planar surface of the front side 210 of the antenna cover plate 202 abuts the outer surface 230 of the wall 10 of the measurement chamber.

The prior art assembly 200 shown in FIGS. 6 and 7 is likely to suffer from the above-mentioned leakage problems that are relatively common in food processing systems. For example, high pressures within the measurement chamber 10 tend to force juices along the seam 232 (FIG. 7) between the sidewall 220 of the dielectric window body 208 and the window opening sidewall surface 224 on the measurement chamber 10. It has been found that leakage along seam 232 in the prior art assembly 200 can be substantial, and quite often begins to attack the integrity of the adhesive 214 prematurely. Over time, deterioration of the adhesive 214 is exacerbated and leakage along seam 232 actually migrates into the grove in the dielectric body 208 containing the antenna loop 204. As mentioned, this can cause a short circuit, or otherwise compromise the performance of the system.

In addition, it should be apparent from FIGS. 6 and 7 that the electrical connectors, cables, fasteners and the like are generally exposed. As mentioned, this is not desirable in food processing applications because of the sanitary requirements for high pressure washdowns. It has been found that leakage from the backside 212 is also a substantial problem.

The invention, as illustrated in FIGS. 2–5, greatly reduces the leakage problems found in the prior art. Referring to FIG. 2, a transmitting antenna assembly 16 is mounted to one side of the measurement chamber 10 for an in-line, guided-microwave spectrometer, and a receiving antenna assembly is mounted on the opposite side of the measurement chamber 10. The assemblies 16, 18 including the mounting configurations are preferably identical to one another. The electromagnetic and electronic aspects of the guided-microwave spectrometer are well documented in the prior art literature. For example, U.S. Pat. No. 5,455,516 by Buford R. Jean et al., entitled "Meter and Method for In-Situ Measurement of the Electromagnetic Properties of Various Processed Materials Using Cut-Off Frequency Characterization and Analysis", issuing on Oct. 3, 1995 and incorporated herein by reference. The discussion herein focuses on the mounting assembly.

Referring to FIG. 2, the antenna assemblies 16, 18 generally include an antenna mounting plate 24, preferably made of stainless steel, a dielectric antenna window body 26, an antenna 28, electrical connectors and fasteners (generally not shown in FIG. 2 except for fasteners 30), coaxial microwave cable 32 which is connected to the antenna 28, a back cover 34, and conduit 36 for the coaxial microwave cable 32. Antenna assemblies 16, 18 constructed in accordance with the invention are preferably designed to fit within the same windows 20, 22 through the walls of the measurement chamber 10 as the prior art assembly 200 shown in FIGS. 6 and 7.

Figure 4:
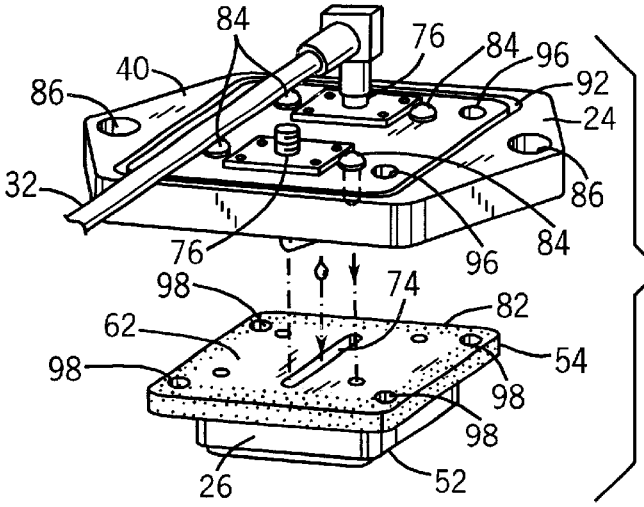
FIG. 4 is a partial assembly view of the preferred embodiment of the mounting assembly.
Figure 5:
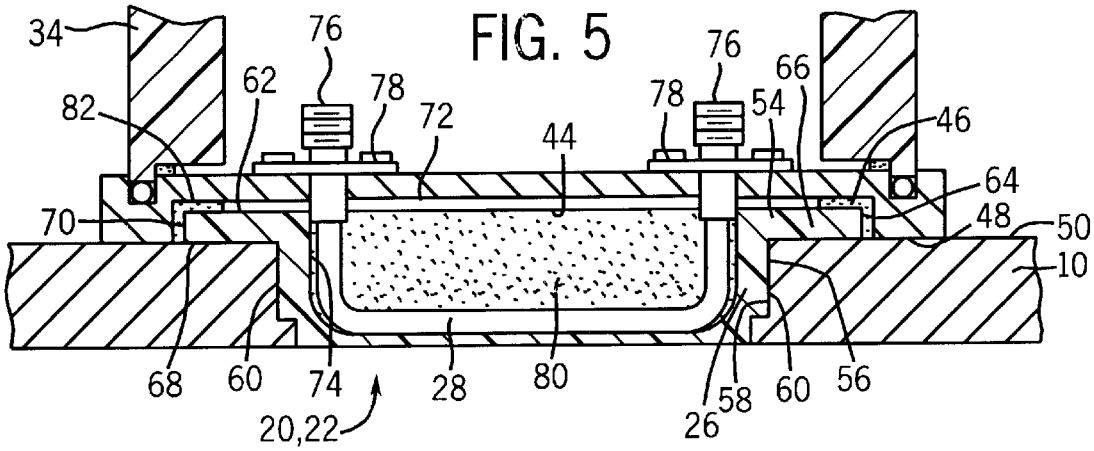
FIG. 5 is a cross-sectional view illustrating the preferred embodiment of the antenna mounting assembly.

Referring now to FIGS. 3–5, the antenna cover plate 24 includes an antenna side 38 and a connector side or backside 40. The antenna 28 is mounted to the cover plate 24 such that the antenna loop 28 extends perpendicularly away from the antenna side 38 of the plate. In accordance with the invention, the antenna side 38 of the antenna cover plate 24 includes a recessed region 42 completely surrounding the base of the antenna 28. The recessed region 42 preferably comprises a planar recessed surface 44 and recess sidewalls 46 which are substantially perpendicular to the planar recessed surface 44. A planar abutment surface 48 surrounds the recess 42 on the antenna side 38 of the antenna cover plate 24, and constitutes the remaining portion of the antenna side 38. The planar abutment surface 48 on the antenna side 38 of the antenna cover plate 24 engages the outer surface 50 of the wall of the measurement chamber 10 (FIG. 5). Preferably, the planar recessed surface 44 is parallel with the plane in which the abutment surface 48 lies.

The dielectric antenna window body 26 includes a main body portion 52, and in accordance with the invention a flange 54. The main body portion 52 is similar in dimensions to the entire dielectric antenna window body 208 of the antenna assembly 200 of the prior art (FIGS. 6 and 7). Although the dimensions of the main body 52 are not critical to the invention, it is important that the main body 52 fit snugly within the window 20, 22 through the wall of the measurement chamber 10. The sidewalls 56 of the main body portion 52 abut window frame surface 58 on the measurement chamber wall 10 along a seam 60.

The flange 54 on the dielectric window body 26 extends perpendicularly outward from the backside surface of the dielectric window body 26. The flange 54 preferably has a planar backside 62, and is sized to fit closely within the recess 42 in the antenna side 38 of the antenna cover plate 24. The peripheral edge surface 64 of the flange 54 is preferably perpendicular to the planar backside surface 62. The flange 54 also includes a planar abutment surface 66 which extends from an end of the side surface 56 on the main body portion 52 of the dielectric window body 26 to the peripheral side surface 64 of the flange 54. The planar abutment surface 66 of the flange 54 is preferably parallel to the planar backside surface 62 of the flange 54 and perpendicular to the peripheral side surface 64 of the flange 54. The interface between the abutment surface 66 of the flange 54 and the outer surface 50 of the wall 10 of the measurement chamber forms seam 68. Seams 68 and 48 are preferably coplanar. The interface between the peripheral side surface 64 of the flange 54 and the peripheral wall 46 for the recess 42 on the antenna side 38 of the antenna cover plate 24 is seam 70. The interface between the planar recess surface 44 on the antenna side 38 of the antenna cover plate 24 and the planar backside surface 62 of the flange 54 is seam 72. A longitudinal groove 74 for the antenna 28 is provided through the backside planar surface 62 into the dielectric wind w body 26. The dielectric window body 26 is preferably made of a molded polymeric material, although it is understood that other satisfactory materials and forming methods may be employed.

Microwave cable connectors 76 are mounted on the connector side or backside 40 of the antenna cover plate 24 using brackets 78 which are fastened to the plate 24. In use, coaxial cables 32 are attached to connector 76.

In order to install the assembly 16, 18, silicone grease 80 is preferably smeared within longitudinal groove 74 in the dielectric window body 26. In addition, adhesive 82, preferably epoxy resin adhesive, is applied along the peripheral edge side surface 54 and adjacent backside surface 62 on the flange 54. Then, the dielectric antenna window body 26 is inserted over the antenna 28 and into the recess 42 on the antenna side 38 of the antenna cover plate 24. Screw fasteners 84 (FIG. 4) secure the dielectric antenna window body 26 to the cover plate 24. The antenna cover plate 24 with the dielectric window body 26 attached thereto is then be mounted onto the measurement chamber 10 over the window 20, 22 by securing fasteners through fastener holes 86.

FIG. 5 shows the assembly 16, 18 mounted over the window in the wall 10 of the measurement chamber. From FIG. 5, it is apparent that the adhesive 82 located in seam 70 between the flange 54 and the recess 42 in the antenna cover plate 24 is isolated from direct leakage pressure penetrating along seam 60. Seam 60 is substantially offset from seam 70 in which the adhesive 82 resides. In addition, seam 70 interfaces against the outer surface 50 of the wall 10 of the measurement chamber. Because the seam 70 and the adhesive 82 contained therein are isolated from seam 60 adjacent the main portion 52 of the dielectric window body 26, the adhesive 82 does not deteriorate prematurely and does not allow leakage premature. In addition, the application of silicone grease 80 within the groove 74 encapsulates the antenna 28 to presserve antenna 28 in the event moisture becomes present inside antenna cover plate 24.

Referring now in particular to FIG. 3, the back cover 34 contain an inner cavity 84 for containing the electrical connections and fasteners on the backside or connector side 40 of the antenna cover plate 24. The backside cover 34 is preferably a NEMA4 container. Around the internal cavity 84, the back cover 34 includes support walls 86 through which fastener bores 88 are provided. The peripheral edge of the back cover 34 includes a projecting rim 90. The backside 40 of the antenna cover plate 24 includes a groove 92 that entirely surrounds the microwave connectors 76 as well as most of the fastening holes 84, 96 through the cover plate 24. In order to mount the back cover 34, an O-ring 94 is placed in the groove 92 in the backside 40 of the antenna cover plate 24, and then the edge of the projecting rim 90 is placed within the groove 92. Prior to placement of the back cover 34 onto the plate 24, the coaxial cable 32 should be run through the conduit 36 and attached on the appropriate connector 76. It may also be desirable to smear silicone grease on the backside components. The back cover 34 is secured to the plate and the dielectric window body 26 by placing fasteners 30 through bores 88 in the back cover, through fastener holes 96 in the antenna cover plate 24, and into holes 98 in the flange 54 of the dielectric antenna window body 26. O-rings are provided around fasteners 30 in order to prevent leakage along the stem of the fasteners 30. With this construction, the backside of the assemblies 16, 18 are particularly well suited to withstand high pressure washdowns, and also protect the components under the continually wet conditions normally prevalent in food processing applications.

The invention has been described herein in connection with a preferred embodiment of the invention. Various alternatives and other embodiments are contemplated as being within the scope of the following claims which particularly point out and distinctly claim the subject matter regarded as the invention.

I claim:

1. In a processing system having an in-line guided-microwave spectrometer that includes a measurement chamber through which food product passes, a transmitting antenna located within a first dielectric antenna window body that is mounted within an antenna window through a side of the measurement chamber, and a receiving antenna located within a second dielectric antenna window that is mounted within an antenna window through an opposite side of the measurement chamber, an improved mounting assembly for the antennas comprising:

an antenna including an antenna loop and a pair of microwave connectors for the antenna loop;

an antenna cover plate that mounts to the measurement chamber over an antenna window, the antenna cover plate having an antenna side and a connector side on which the microwave connectors are located, wherein the antenna loop is mounted to the antenna cover plate such that the antenna loop extends away from the antenna side and the antenna cover plate further includes a recess in the antenna side that surrounds the antenna loop; and a dielectric window body that covers the antenna loop and is mounted to the antenna side of the antenna cover plate, the dielectric window body having a main body portion that extends away from the antenna cover plate and fits closely within the antenna window on the side of the measurement chamber when the antenna cover plate is mounted to the measurement chamber, and a flange that extends peripherally outward from the main portion and fits closely within the recess in the antenna side of the antenna cover plate;

wherein a peripheral edge of the flange abuts a wall in the antenna cover plate defining a perimeter of the recess in the antenna side of the antenna cover plate along a seam which is located such that it interfaces entirely against an outer surface of the wall of the measurement chamber surrounding the antenna window when the antenna cover plate is mounted to the wall of the measurement chamber over the antenna window.

2. A mounting assembly as recited in claim 1 wherein the dielectric window body includes an exposed side and a flange side, and further comprises:

a longitudinal groove for the antenna loop which extends through the flange side of the dielectric window body and into the main portion of the dielectric window body; and sealant that fills the longitudinal groove to seal the antenna within the longitudinal groove.

3. A mounting assembly as recited in claim 1 further comprising adhesive along at least a portion of the seam between the flange of the dielectric window body and the recess in the antenna cover plate.

4. A mounting assembly as recited in claim 1 further comprising:

a groove in the connector side of the antenna cover plate that entirely surrounds the pair of microwave connectors; and a back cover having a cavity therein and a projecting rim that completely surrounds a base of the cavity, the back cover being mounted to the antenna cover plate such that the rim on the back cover resides within the groove on the connector side of the antenna cover plate and the pair of microwave connectors are contained within the cavity in the back cover.

5. A mounting assembly as recited in claim 4 further comprising an O-ring located within the groove in the connector side of the antenna cover plate and located between the antenna cover plate and an edge of the projecting rim on the back cover.

6. A mounting assembly as recited in claim 4 further comprising:

an opening in the back cover for a microwave cable; and flexible conduit leading to the opening in the back cover and being connected to the back cover such that microwave cable being fed to the back cover through the conduit is completely covered as it approaches and enters the back cover.

7. A mounting assembly as recited in claim 6 further comprising a conduit connector that connects the conduit to the back cover around the opening, said conduit connector being detachable.

8. A mounting assembly as recited in claim 1 wherein side surfaces of the main body portion of the dielectric window body are substantially perpendicular to a plane in which a face surface of the dielectric window body resides and the flange has an abutment surface that is substantially perpendicular to the side surfaces on the dielectric window body.

9. A mounting assembly as recited in claim 1 wherein the antenna side of the antenna cover plate has a generally planar abutment surface that surrounds the recess in the antenna side of the antenna cover plate.

10. A mounting assembly as recited in claim 9 wherein the recess in the antenna side of the antenna cover plate comprises:

a generally planar recessed surface that is parallel to a plane in which the planar abutment surface of the cover plate resides; and the perimeter of the recess is defined by a wall that is substantially perpendicular to the planar recessed surface.

11. A mounting assembly as recited in claim 9 wherein the flange has a planar abutment surface that resides in substantially the same plane as the planar abutment surface of the antenna cover plate.

12. In a food processing system having an in-line guided-microwave spectrometer that includes a measurement chamber through which processed food product passes, a transmitting antenna located within a first dielectric antenna window body that is mounted within an antenna window through a side of the measurement chamber, and a receiving antenna located within a second dielectric antenna window body that is mounted within an antenna window through an opposite side of the measurement chamber, an improved mounting assembly for the antennas comprising:

an antenna including an antenna loop and a pair of microwave connectors for the antenna loop;

an antenna cover plate that mounts to the measurement chamber over an antenna window, the antenna cover plate having an antenna side and a connector side in which the microwave connectors are located, wherein the antenna loop is mounted to the antenna cover plate such that the antenna loop extends away from the antenna side and the antenna cover plate further includes a recess on the antenna side that surrounds the antenna loop; and a dielectric window body that covers the antenna loop and is mounted to the antenna side of the antenna cover plate, the dielectric window body having a main body portion that extends away from the antenna cover plate and fits closely within the antenna window on the side of the measurement chamber when the antenna cover plate is mounted to the measurement chamber, and a flange that extends peripherally outward from the main portion and fits closely within the recess in the antenna side of the antenna cover plate;

wherein a side surface of the main body portion of the dielectric window body abuts a window opening sidewall surface surrounding the antenna window through the side of the measurement chamber along a first seam, and a peripheral edge of the flange abuts a wall in the antenna cover plate defining a perimeter of the recess in the antenna side of the antenna cover plate along a second seam, the second seam being located such that it is offset from the first seam when the antenna cover plate is mounted to the wall of the measurement chamber over the antenna window.

13. A mounting assembly as recited in claim 12 wherein the dielectric window body includes an exposed side and a flange side, and further comprises:

a longitudinal groove for the antenna loop which extends through the flange side of the dielectric window body and into the main portion of the dielectric window body; and sealant that fills the longitudinal groove to seal the antenna within the longitudinal groove.

14. A mounting assembly as recited in claim 12 further comprising food-grade epoxy resin adhesive along at least a portion of the second seam which is between the flange of the dielectric window body and the recess in the antenna cover plate.

15. A mounting assembly as recited in claim 12 further comprising:

a groove in the connector side of the antenna cover plate that entirely surrounds the pair of microwave connectors; and a back cover having a cavity therein and a projecting rim that completely surrounds a base of the cavity, the back cover being mounted to the antenna cover plate such that the rim on the back cover resides within the groove on the connector side of the antenna cover plate and the pair of microwave connectors are contained within the cavity in the back cover.

16. A mounting assembly as recited in claim 15 further comprising an O-ring located within the groove in the connector side of the antenna cover plate and located between the antenna cover plate and an edge of the projecting rim on the back cover.

17. A mounting assembly as recited in claim 15 further comprising:

an opening in the back cover for a microwave cable; and flexible conduit leading to the opening in the back cover and being connected to the back cover such that microwave cable being fed to the back cover through the conduit is completely covered as it approaches and enters the back cover.

18. A mounting assembly as recited in claim 17 further comprising a conduit connector that connects the conduit to the back cover around the opening, said conduit connector being detachable.

19. A mounting assembly as recited in claim 12 wherein side surfaces of the main body portion of the dielectric window body are substantially perpendicular to a plane in which a face surface of the dielectric window body resides and the flange has an abutment surface that is substantially perpendicular to the side surfaces on the dielectric window body.

20. A mounting assembly as recited in claim 12 wherein the antenna side of the antenna cover plate has a generally planar abutment surface that surrounds the recess in the antenna side of the antenna cover plate.

21. A mounting assembly as recited in claim 20 wherein the recess in the antenna side of the antenna cover plate comprises:

a generally planar recessed surface that is parallel to a plane in which the planar abutment surface of the cover plate resides; and the perimeter of the recess is defined by a wall that is substantially perpendicular to the planar recessed surface.

22. A mounting assembly as recited in claim 20 wherein the flange has a planar abutment surface that resides in substantially the same plane as the planar abutment surface of the antenna cover plate.

* * * * *